United States Patent [19]

Faldella et al.

[11] 4,276,747

[45] Jul. 7, 1981

[54] HEAT RECOVERY SYSTEM

[75] Inventors: Roberto Faldella; Riccardo Margary, both of Turin, Italy

[73] Assignee: Fiat Societa Per Azioni, Turin, Italy

[21] Appl. No.: 965,133

[22] Filed: Nov. 30, 1978

[51] Int. Cl.[3] ..... F01K 23/10

[52] U.S. Cl. ..... 60/618; 60/676; 60/677

[58] Field of Search ..... 60/616, 618, 676, 677, 60/715, 707

[56] References Cited

U.S. PATENT DOCUMENTS

| | | | |
|---|---|---|---|
| 1,339,177 | 5/1920 | Dyer | 60/618 |
| 2,384,587 | 9/1945 | Badenhausen | 60/676 X |
| 3,611,718 | 10/1971 | Nebgen | 60/677 X |
| 3,830,062 | 8/1974 | Morgan et al. | 60/618 |
| 4,099,489 | 7/1978 | Bradley | 60/618 X |

FOREIGN PATENT DOCUMENTS

| | | | |
|---|---|---|---|
| 343716 | 2/1960 | Switzerland | 60/676 |

*Primary Examiner*—Allen M. Ostrager

*Assistant Examiner*—Stephen F. Husar

*Attorney, Agent, or Firm*—Sughrue, Rothwell, Mion, Zinn and Macpeak

[57] ABSTRACT

A heat recovery system for the production of mechanical energy from a plurality of different heat sources at different temperatures comprises a plurality of heat exchangers associated one with each heat source, a plurality of circuits for a working fluid which traverses the heat exchangers, the circuits including expansion devices in which the working fluid is expanded and possibly vaporized to derive mechanical work from it, this being accompanied by a fall in temperature; the circuits for the working fluid have certain parts in common, such as the heat exchanger associated with the heat source at the lowest temperature, at least one of the expansion devices, a condenser in which working fluid vaporized in the expanders can be recondensed, and a circulation pump for driving the working fluid around the circuits. Certain of the circuits may have further circulation pumps and also auxiliary heat exchangers for preheating the working fluid with residual heat in the fluid after passing through one or more expanders.

2 Claims, 17 Drawing Figures

100
120
170
90
190
180
110
160
130
80
100
150
40
19
140
30
100
20
80

170
180
100
90
80
19
110
130
190
110
120
40
140
30
19
20
80

180
170
100
90
120
110
160
130
110
80
190
19
100
40
20
140
30
150
80

HEAT RECOVERY SYSTEM

BACKGROUND OF THE INVENTION

The present invention relates to a system for the production of mechanical energy from a plurality of heat sources at different temperatures. A particularly suitable application for a system of the present invention is in the recovery of heat from a heat engine such as an internal combustion engine running on gasoline or diesel oil. Such engines produce excess heat which is usually merely dissipated by a coolant system and thereby wasted. Moreover the exhaust gases emitted by such engines enter the atmosphere at high temperatures but the heat of such gases is again merely allowed to dissipate and be wasted. This is true not only of engines used in automobiles, but also heavy commercial engines used in shipping and even the large scale motors used for the central generation of electricity. All this waste heat could be turned into useful mechanical energy if suitable systems for doing this were available but until the present invention there was no system for converting the heat from several heat sources at different temperatures into useful mechanical work.

OBJECTS OF THE INVENTION

The primary object of the invention is to provide a system for producing mechanical work from a plurality of heat sources at different temperatures.

A secondary object of the invention is to provide such a system which will be constructively simple and which can operate with a high thermodynamic efficiency.

SUMMARY OF THE INVENTION

According to the invention, therefore, there is provided a heat recovery system, for the production of mechanical energy from a plurality of heat sources at different temperatures, including a plurality of heat exchangers, means for connecting at least one heat exchanger in heat receiving relation with each said heat source, a plurality of expanders, at least one condenser operating to condense said working fluid as it passes therethrough, at least one circulation pump, a plurality of circuits interconnecting said plurality of heat exchangers and said plurality of expanders, for a working fluid which receives heat from said plurality of heat sources at said heat exchangers and which traverses said expanders to transform the heat received from said plurality of heat sources into mechanical energy, each of said circuits for said working fluid including at least one of said heat exchangers, at least one of said expanders for expanding said working fluid after it leaves said at least one heat exchanger, said condenser disposed in circuit between said at least one expander and said at least one heat exchanger and operating to condense said working fluid after it leaves said at least one expander, and said at least one circulation pump for circulating said working fluid around said circuit, respective pairs of said plurality of circuits for said working fluid having parts thereof common to both circuits of a pair, said common parts including at least one of said expanders and said condenser.

When used in this specification the term "expander" will be understood to refer to an expansion device in which a working fluid is caused to expand thereby experiencing a drop in temperature and performing mechanical work. Such expansion may or may not be associated with vaporisation of the working fluid. Expansion devices suitable for the purposes of the present invention are known in the art and since the precise nature of these devices is not critical to and does not form part of the present invention they will not be described herein in greater detail.

The working fluid can be the same for all the circuits of the system, or else can be a mixture of fluids, each of which seperates out by evaporation in one of the heat exchangers, subsequently being remixed with the remaining fluid upstream of one of the expanders.

The system according to the present invention is adapted to be used in any circumstances where there are available a plurality of heat sources at different temperatures. The system is particularly suitable, however, as outlined above, for converting waste heat recovered from the cooling circuit of an internal combustion engine and from the exhaust gases emitted by such an engine, into mechanical work.

Preferably, an embodiment of the invention is formed as a system adapted to recover heat from two heat sources respectively constituted by the cooling circuit of a heat engine and the exhaust gases emitted by said heat engine, said system including first and second expanders, an exhaust gas heat exchanger through which, in use, pass at least part of the exhaust gases emitted by said engine, a duct for said working fluid which receives heat from the cooling circuit of the said engine, said duct branching into first and second branch ducts downstream of said cooling circuit, said first branch duct traversing said exhaust gas heat exchanger and said first expander, said second branch duct rejoining said first branch duct upstream of said second expander, a further circulation pump in said first branch duct, said at least one circulation pump and said condenser being located in said duct for said working fluid downstream of said second expander.

The quantities of heat on average recoverable from the cooling circuit of an engine is about the same as that recoverable from the exhaust gases. Therefore, if all the working fluid were to pass through the exhaust gas heat exchanger, the temperature increase of the working fluid obtainable in the recovery of heat from the exhaust gas would be, at most, about equal to the temperature increase of the working fluid obtainable in the recovery of heat from the cooling system of the engine. Since this latter temperature increase is limited by the requirement for proper operation of the engine, the maximum temperature attainable by the working fluid in the cycle would in that case be rather low, thereby prejudicing good thermodynamic efficiency of the heat recovery cycle itself. By making only a part of the flow of fluid which receives heat recovered from the cooling circuit of the engine pass through the exhaust gas heat exchanger, there is obtained the advantage of being able to make such part attain a higher temperature than would be the case if all the working fluid were to be passed through the exhaust gas heat exchanger, thereby obtaining temperatures and pressures which are optimum for the purposes of the thermodynamic efficiency of the cycle used.

The fluid which receives heat from the cooling circuit of the engine can be either the same fluid as the engine coolant (i.e. it may pass through the engine cooling jacket) or it may be a working fluid heated indirectly by means of a heat exchanger through which the engine coolant flows.

The heat engine in connection with which the system according to the present invention is used may be of any type, that is a type operating on an Otto cycle or a Diesel cycle, and may be air-cooled or water-cooled.

If the system according to the present invention is used on a heat engine which is normally air-cooled, it is necessary to provide such an engine with an auxiliary cooling jacket within which the working fluid is made to flow. In this case therefore the working fluid replaces air as the engine coolant.

Instead of branching downstream of one of the heat exchangers or heat sources, the main duct for the working fluid may branch into first and second branch ducts upstream of both or all the heat sources. This has particular advantages if the heat sources are constituted by the cooling circuit of the engine and the exhaust gas emitted by the engine since it permits the location of the said circulation pump upstream (rather than downstream) of the heat source constituted by the cooling circuit of the heat engine, thereby avoiding the risk of cavitation in this pump.

In all applications of the system of the present invention for transforming heat recovered from the cooling circuit of a heat engine and the exhaust gases emitted by such an engine into mechanical energy, it is possible to include a heat regeneration cycle for the working fluid by inserting into the first branch duct, upstream of the exhaust gas heat exchanger, another heat exchanger through which passes, in heat transmitting relation, the fluid flowing from the output of the first expander. In this case the system according to the invention can also be provided with a second exhaust gas heat exchanger in the second branch duct and traversed by exhaust gases coming from the exhaust gas heat exchanger in the first branch duct.

The system of the present invention may further include an auxiliary heat exchanger for heating the working fluid. Such auxiliary heat exchanger can be heated by the lubrication oil of the engine or alternatively, in the case of an engine provided with supercharger, by the air of the supercharger system.

A system according to the present invention can be used, for example, not only in relation to an internal combustion engine of an automobile, but also in relation to a heavy diesel engine (of the marine type or the type used for the central generation of electricity) in which there are a larger number of heat sources at different temperatures. Such heat sources would be constituted, for example, by the piston coolant liquid, by the cylinder coolant liquid, by the supercharging air of the engine, and by the exhaust gases emitted by the engine. In this case the system of the present invention includes at least four heat exchangers each connected to receive a respective one of said heat source fluids, first and second expanders, a main duct for said working fluid, which duct separates into first and second branch ducts upstream of said heat exchangers, said first branch duct traversing all said heat exchangers and both said first and said second expander, and said second branch duct traversing all said heat exchangers but only said second expander.

Preferably the system of the invention includes in this case a further heat exchanger for preheating the working fluid which flows through the first branch duct before it enters the exhaust gas heat exchanger, the said further heat exchanger being traversed in heat transmitting relation by the working fluid which flows through the first branch duct downstream of that expander which is traversed only by working fluid in the first branch duct.

Other characteristics and advantages of the present invention will become clear from reading the following description, in which reference is made to the accompanying drawings, provided purely by way of non-limitative example.

DESCRIPTION OF THE PREFERRED EMBODIMENTS

Figure 1:
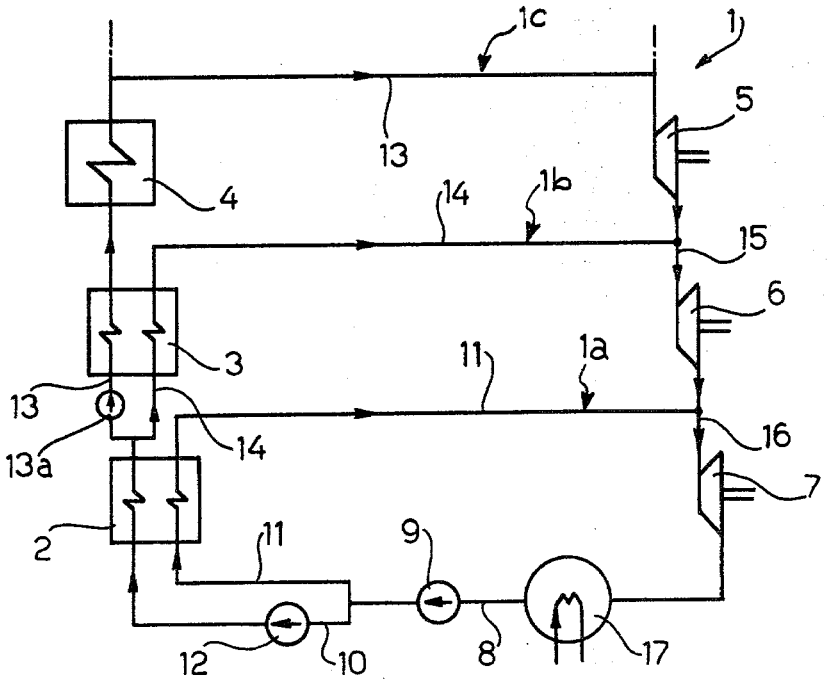
FIG. 1 is a schematic diagram of a system constituting a first embodiment of the present invention.

In FIG. 1 there is shown, generally indicated with the reference numeral 1, a heat recovery system according to the present invention for use in an industrial installation in which there are available three heat sources at different temperatures. The heat recovery system 1 includes a first heat exchanger 2 associated with a first heat source having a temperature which is lower than that of the other two heat sources (for example constituted by coolant liquid for the machinery of the installation). A second heat exchanger 3 associated with a second heat source the temperature of which is higher than that of the first heat source (for example constituted by steam or a solar panel), and a third heat exchanger 4 associated with a third heat source the temperature of which is higher than those of the first and second heat sources (for example constituted by exhaust gases). For convenience, hereinafter the heat exchanger 4 associated with the higher temperature source will be referred to as the "high temperature" heat exchanger and correspondingly the heat exchangers 3 and 2 will be referred to as the "mid-temperature" heat exchanger and the "low temperature" heat exchanger respectively. It will be appreciated, however, that this does not indicate any difference in the heat exchangers which may, in fact, be identical, but rather identifies the heat source with whch the heat exchanger is associated. Likewise, the terms "high temperature" and "low temperature" will be understood as indicating only the relative temperature with respect t the temperatures of the other heat sources.

The heat recovery system 1 also includes thre expanders connected in series with one another. A first expander 5 operating at the highest pressure, a second expander 6 operating at an intermediate pressure, and a third expander 7 operating at the lowest pressure. The system further includes a circulator pump 9 in a main duct 8 for the working fluid, which leads from the output of the low pressure expander 7, via a condenser 17 the function of which will be described more fully below, to the pump 9 and from there to a point where the duct 8 separates into first and second branches 10, 11 respectively, which both traverse the low temperature heat exchanger 2. When used in this specification the term "traverse" when applied to a duct or a branch of a duct, will be understood to indicate that the duct directs fluid through the component traversed, although in practical terms the duct may not itself pass through the component. For example, the duct may be connected to input and output connectors of a heat exchanger, and this will be unerstood to be included by the term "traversed". In the branch 10 of the duct, upstream from the low temperature heat exchanger 2, however, there is located a second circulator pump 12, and the branch 10 of the duct, at a point downstream from the low temperature heat exchanger 2, separates into two further branch ducts 13, 14 which both traverse the mid-temperature heat exchanger 3. A further circulator pump 13*a* is located in the branch duct 13 upstream of the mid-temperature heat exchanger 3. Downstream from the mid-temperature heat exchanger 3 branch duct 13 traverses the high temperature heat exchanger and then traverses the high pressure expander 5, after which it is rejoined by the branch duct 14 at a junction point to which the branch duct 14 leads directly from the mid-temerature heat exchanger 3. From this junction point the two branch ducts 13, 14 continue as a single common duct 15 which traverses the second expander (the mid-pressure expander) downstream from which it is joined by the branch 11 which leads directly from the low temperature heat exchanger 2. From the junction point of the ducts 11 and 15 these continue as a single common duct 16 which feeds the working fluid to the low pressure expander 7. The output side of the low pressure expander 7 is connected to the duct 8 which traverses the condenser 17 in which the vapour in the working fluid at the output of the expander 7 is condensed before the working fluid is passed, as a liquid, to the pump 9.

The system of FIG. 1 thus includes in effect three circuits for the working fluid: a first circuit 1*a* comprising the ducts 8, the branch duct 11, and the common duct 16; a second circuit 1*b* comprising the main duct 8, the branch ducts 10 and 14, and the common ducts 15 and 16, and a third circuit 1*c*, comprising the main duct 8, the branch ducts 10 and 13, and the common ducts 15 and 16. The three circuits for the working fluid all have in common that portion of the circuit including the low pressure expander 7, the condenser 17 and the main pump 9. Any two circuits have in common the pump 9, the condenser 17 and at least one expander. For example the first circuit 1*a* and the second circuit 1*b* have in common the section comprising the common duct 16 and the main duct 8. The second circuit 1*b* and the third circuit 1*c* have in common the section comprising the common ducts 15 and 16, the main duct 8 and the branch duct 10. The first circuit 1*a* and the third circuit 1*c* have in common the section comprising the common duct 16 and the main duct 8.

Because of the particular structure described above, a first part of the total flow of working fluid, that is the part which flows in the duct 11, traverses only the low temperature heat exchanger 2 and the expander 7. A second part of the total flow of working fluid, that is the part which flows in the branch ducts 12 and 14, traverses both the low temperature and the mid-temperature heat exchangers 2 and 3, and the mid pressure and low pressure expanders 6 and 7. The remaining part of the total flow of working fluid traverses all three heat exchangers 2,3 and 4, and all three expanders 5,6 and 7.

Figure 2:
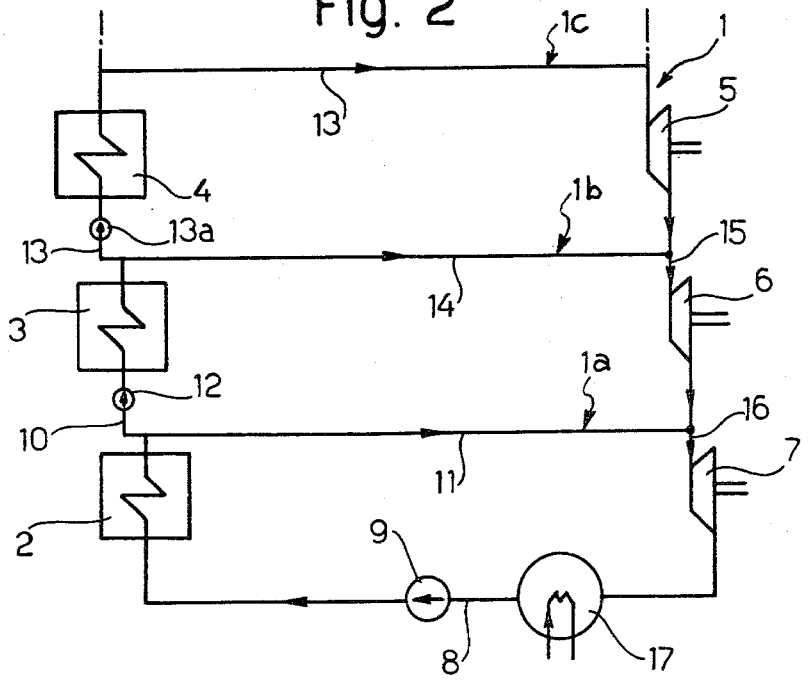
FIG. 2 is a schematic diagram of a system constituting a variant of the embodiment of FIG. 1.

FIG. 2 illustrates a variation of the embodiment of FIG. 1 in which the working fluid is constituted by a mixture of three fluids, each of which separates out from the remaining mixture by evaporation in a respective heat exchanger.

Those parts of the embodiment of FIG. 2 which are the same as, or fulfil the same function as, corresponding parts of the embodiment of FIG. 1, have been indicated with the same reference numerals. The system shown in FIG. 2 is broadly similar to the system shown in FIG. 1 but differs from it in that each heat exchanger in the system of FIG. 2 is traversed by only a single duct with splits into two separate branches downstream of each heat exchanger. Moreover the pumps 12 and 13*a* are located downstream of the low-temperature and mid-temperature heat exchangers 2 and 3 respectively instead of being located upstream of these as in the system of FIG. 1.

In operation, the mixture of liquids and vapours of the three working fluids coming from the outlet of the expander 7 is cooled below the condensation point of the fluid with the lowest condensation temperature in the condenser 17. The mixture of liquids coming out of the condenser 17, and flowing in the duct 8, passes through the pump 9 and then through the low temperature heat exchanger 2. The values of temperature and pressure are such that one of the three working fluids evaporates, and separates from the mixture downstream from the heat exchanger 2. The practical arrangement is such that the evaporated fluid passes through the duct 11 and is mixed with the fluid coming from the outlet of the expander 6 before the resultant mixture passes through the expander 7 on its way back to the duct 8. The rate of flow is such, in relation to the temperature and pressure, that all, or substantially all, of the said one working fluid is evaporated as it passes through the low-temperature heat exchanger 2.

The mixture of the other two fluids, which are not evaporated in the low temperature heat exchanger 2 pass on along the duct 10 and through the pump 12 into the mid-temperature heat exchanger 3. In the heat exchanger 3 the temperature and pressure are such that one of the two fluids constituting the mixture which flows in the duct 10 reaches its evaporation point and separates by evaporation from the other fluid, which remains in a liquid state. The practical arrangement is such that the vaporised fluid flows through the branch duct 14 and the liquid flows along the duct branch 13 through the pump 13*a*. The vapour flowing in the branch duct 14 joins the fluid coming from the expander 5 and mixes therewith. The resultant mixture flows into and through the expander 6, and it is this mixture, as it leaves the expander 6, with which the said one fluid evaporated in the low-temperature heat exchanger 2 is mixed as the latter flows from the duct 11. The third fluid, which does not reach its evaporation point in the heat exchanger 3, and flows on into the duct 13 is driven by the pump 13*a* into the heat exchanger 4 associated with the high temperature heat source, and after leaving this heat exchanger at an increased temperature passes on along the duct 13 to the expander 5 where it does mechanical work upon expanding and cooling, following which it is mixed with the fluid coming from the duct 14 as described above, and the mixture of the two fluids passes on to the mid-pressure expander 6 in which it is expanded and cooled and caused to perform mechanical work.

Naturally the practical constructional details of the systems illustrated in FIGS. 1 and 2 can be widely varied. In particular it is possible to employ one or more regenerative cycles for the working fluid by introducing heat exchangers for further heating the fluid at the output of one of the heat exchangers associated with one of the heat sources of the system, in order to make use of the residual heat contained in the working fluid as it leaves one of the expanders. The systems of FIGS. 1, 2 could, moreover, be utilised (with obvious modifications) in situations where a greater or a smaller number of heat sources at different temperatures are available.

Figure 3:
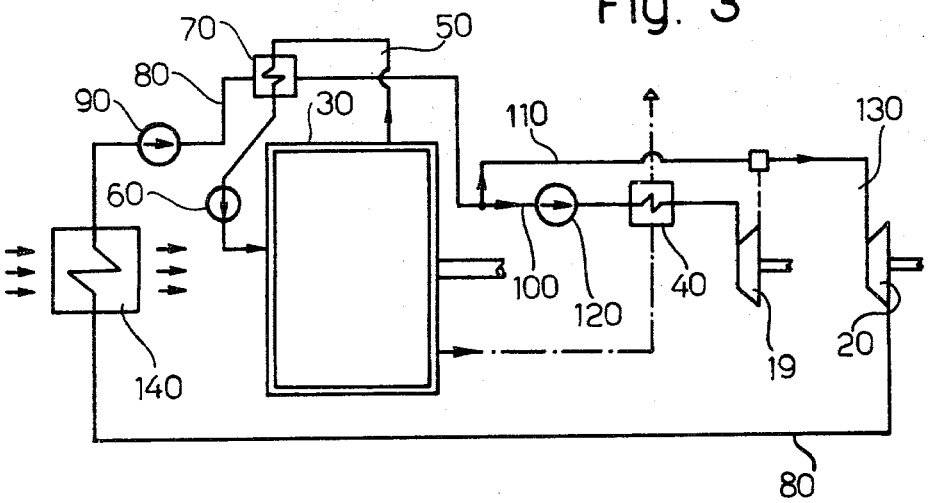
FIG. 3 is a schematic diagram of a system constituting a second embodiment of the invention for use with a liquid-cooled heat engine.

FIG. 3 illustrates a system according to the present invention which is adapted for use with a liquid cooled internal combustion engine 30. The system shown includes a first, high pressure expander 19, and a second, low pressure expander 20 again the terms "high" and "low" are used in relative sense merely to distinguish the two expanders from one another. In this embodiment there are two heat sources respectively constituted by the coolant system of the liquid-cooled heat engine 30 and by the hot exhaust gases emitted by the engine 30. The cooling circuit of the engine 30 includes a duct 50 which is external to the coolant jacket of the engine 30: in series in the duct 50 are a pump 60 and a heat exchanger 70 through which the engine coolant flows as a heating liquid for heating the working fluid of the heat recovery system, which flows in a duct 80 which traverses the heat exchanger 70. Upstream of the heat exchanger 70, in the duct 80 there is located a circulation pump 90. Downstream of the heat exchanger 70 the duct 80 separates into two branch ducts; a first branch duct 100 and a second branch duct 110. The first branch duct 100 traverses a heat exchanger 40 through which the hot exhaust gases flow as heating fluid. Downstream of the heat exchanger 40 the branch duct 100 traverses the high pressure expander 19. The second branch duct 110 rejoins the first branch duct downstream of the high pressure expander 19. In the first branch 100, upstream of the exhaust gas heat exchanger 40, there is a further circulation pump 120. Downstream from the point where the two branch ducts 100, 110 join continues a common duct 130 leading to the low pressure expander 20. The output of the expander 20 is connected to the main working fluid duct 80 which traverses a condenser 140 for condensing the working fluid coming from the expander 20 before leading back to the main circulation pump 90.

Figure 4:
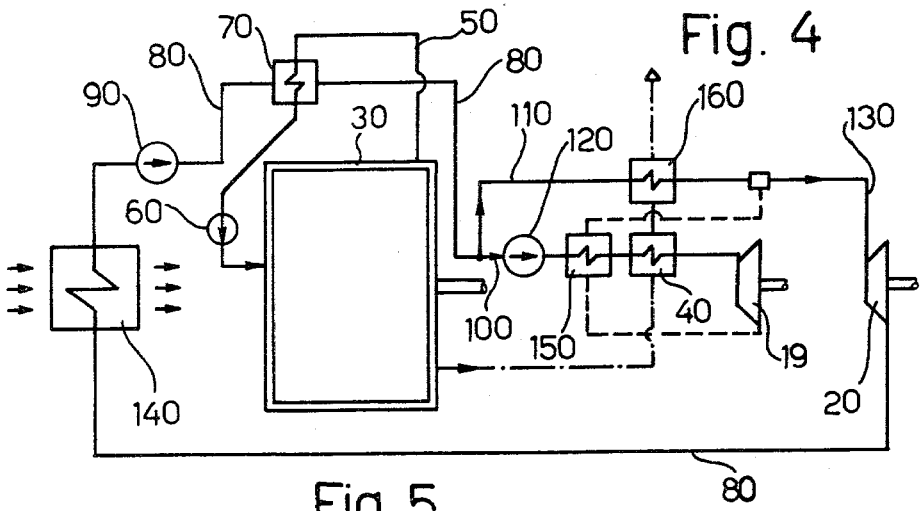
FIG. 4 is a schematic diagram of a system constituting a variant of the embodiment of FIG. 3.

FIG. 4 illustrates a variant of the embodiment illustrated FIG. 3, in which there is a regenerative loop for the working fluid. In this embodiment the system includes a further heat exchanger 150 in the first branch duct 100 upstream of the exhaust gas heat exchanger 40, for preheating the working fluid before this reaches the heat exchanger 40. The heating fluid flowing through the heat exchanger 150 is the working fluid itself, which is directed by that part of the branch duct 100 downstream of the high pressure expander 19 to traverse the heat exchanger 150 thereby giving up some of its residual heat to the incoming working fluid before passing on to the junction point where it rejoins the working fluid in the second branch duct 110.

This system also includes a further heat exchanger 160 heated by the exhaust gases after they have traversed the main exhaust gas heat exchanger 40. The further heat exchanger 160 is traversed by the second branch duct 110 so that working fluid flowing therein is heated before rejoining the working fluid in the first branch duct 100 the temperature of which will be lower than it would be at the corresponding point in the system of FIG. 3 due to the fact that it has lost heat to the incoming working fluid in the heat exchanger 150.

Figure 5:
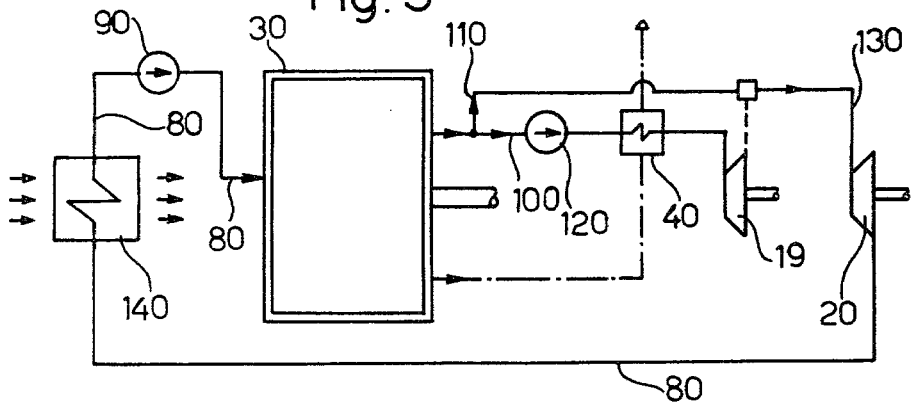
FIG. 5 is a schematic diagram of a system constituting a third embodiment of the invention, for use with an air-cooled heat engine.
Figure 6:
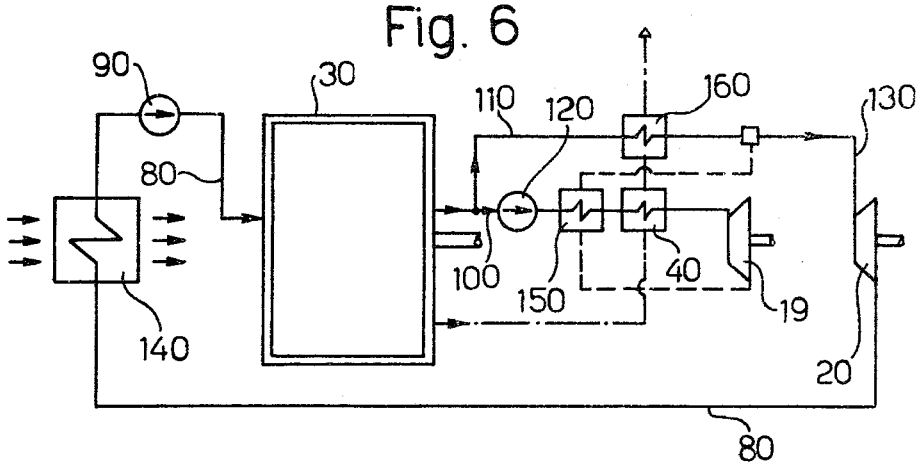
FIG. 6 is a schematic diagram of a system constituting a variant of the embodiment of FIG. 5.

FIGS. 5 and 6 illustrate respectively a third embodiment of the invention and a variant thereof, which are adapted for use with heat engines which are normally air-cooled. In this case it is necessary to provide the engine with an auxiliary cooling jacket, through which the working fluid of the system is made to flow, thus replacing air as the engine coolant. Those parts of the system which are the same as, or fulfill the same functions as, corresponding parts of the system described in relation to FIGS. 3 and 4 will be indicated with the same reference numerals. The system illustrated in FIG. 5 is similar to the system of FIG. 3 except that the main duct 80 for the working fluid, rather than passing through a heat exchanger which is also traversed by the coolant liquid of the engine, passes instead through the auxiliary cooling jacket with which the heat engine 30 is provided. In other words the working fluid of the heat recovery system serves as the coolant fluid for the engine 30. One advantage of the system shown in FIG. 5 is the simplicity of construction and the relatively small number of component parts. Apart from the added coolant jacket the heat engine 30 has added to it only the exhaust gas heat exchanger 40, the feed pump 12, and the two expanders 19, 20. The condenser 140 and the feed pump 90 replace respectively the radiator and the coolant fluid circulation pump usually used in the cooling systems of liquid cooled heat engines. The system according to the invention therefore is of simple construction, small size and low cost.

The variant shown in FIG. 6 is substantially the same system as in FIG. 5, but additionally has a regenerative heating loop created by means of the introduction of the heat exchangers 150 and 160 in a configuration as in the embodiment of FIG. 4: this will thus not again be described in detail.

Figure 7:
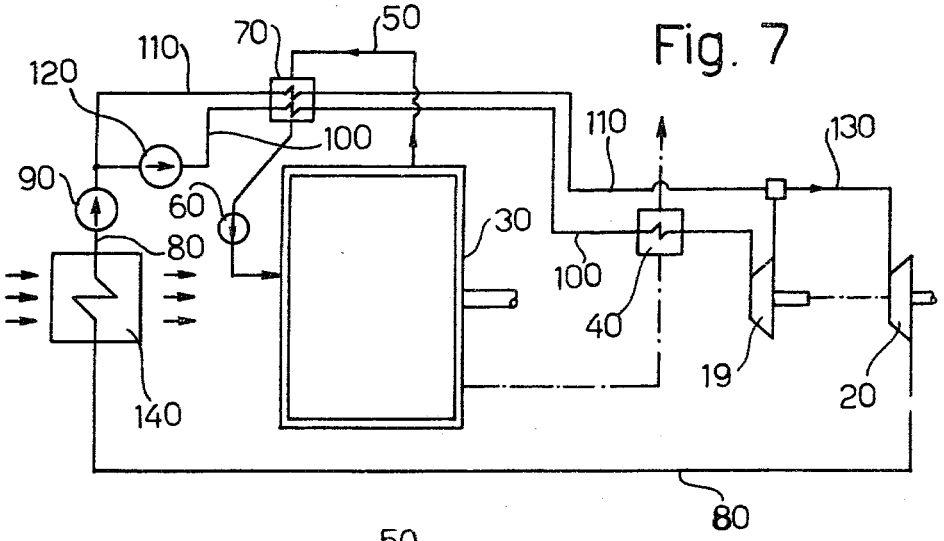
FIGS. 7 and 8 are schematic diagrams of systems constituting variants of the embodiment of FIG. 3.
Figure 8:
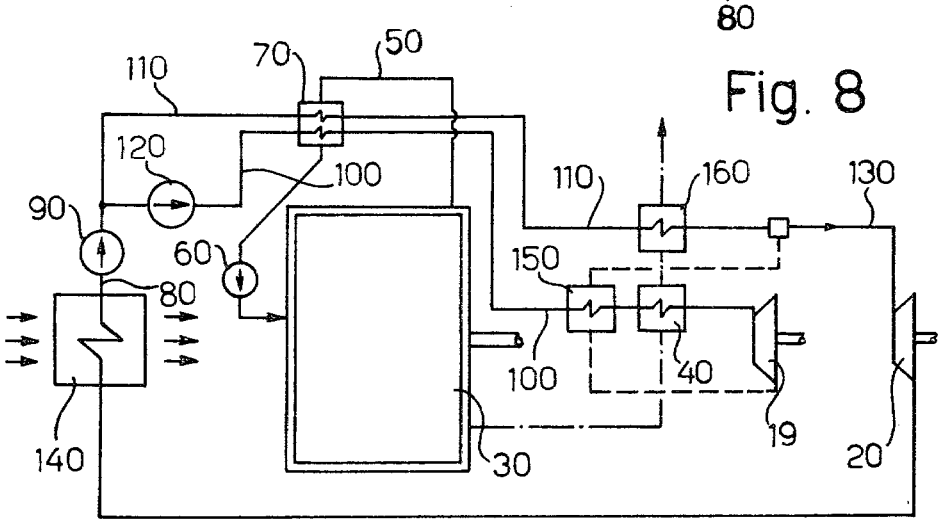

FIGS. 7 and 8 illustrate further embodiments adapted for use with a liquid cooled heat engine. Again, in these Figures those parts which are the same as, or fulfill similar functions to corresponding parts in the embodiments of FIGS. 3 and 4 are indicated with the same reference numerals. The system of FIG. 7 is broadly similar to the system of FIG. 3, the differences being that in the embodiment of FIG. 7 the main duct 80 for the working fluid branches into first and second branch ducts 100, 110 upstream of the heat exchanger 70 which is heated by the coolant liquid whereas in the embodiment of FIG. 3 this branching point is downstream of the heat exchanger 70. Both the first and second branch ducts 100, 110, in the embodiment of FIG. 7, pass through the heat exchanger 70 and the circulation pump 120 in the first branch duct 100 is located upstream of the heat exchanger 70. Having the circulation pump 120 here has the advantage over the location illustrated in FIGS. 3 and 4, of avoiding the risk of possible cavitation of the pump.

The variant illustrated in FIG. 8 corresponds to the embodiment of FIG. 7 but further illustrates the provision of a regenerative heating loop by means of the introduction of the heat exchangers 150 and 160 in a configuration identical with that of FIG. 4.

FIGS. 9 to 16 again relate to systems adapted for use with an air-cooled heat engine. As before, in these systems those component parts which are the same as, or fulfil the same function as, corresponding component parts in the systems illustrated in FIGS. 5 and 6, are herein indicated with the same reference numerals.

Figure 9:
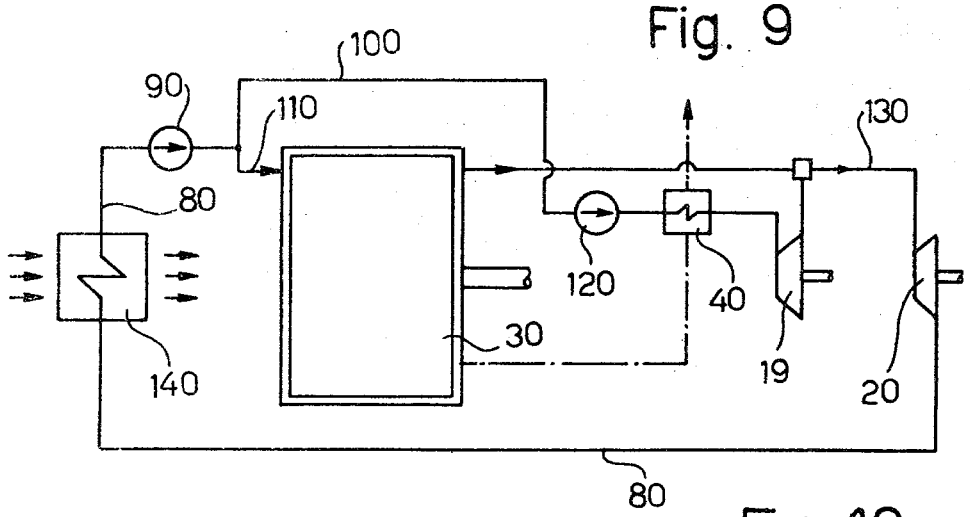
FIGS. 9 to 16 are schematic diagrams of systems constituting variants of the embodiment of FIG. 5.

The principal difference between the embodiment illustrated in FIG. 9 and that illustrated in FIG. 5 lies in the fact that the main duct 80 for the working fluid, instead of branching downstream from the auxiliary cooling jacket of the heat engine 30, branches upstream from it instead. Of the two branch ducts 100, 110, however, only the second branch duct 110 passes through the auxiliary cooling jacket of the heat engine 30: this branch duct rejoins the first branch duct 100 downstream of the high pressure expander 19.

Figure 10:
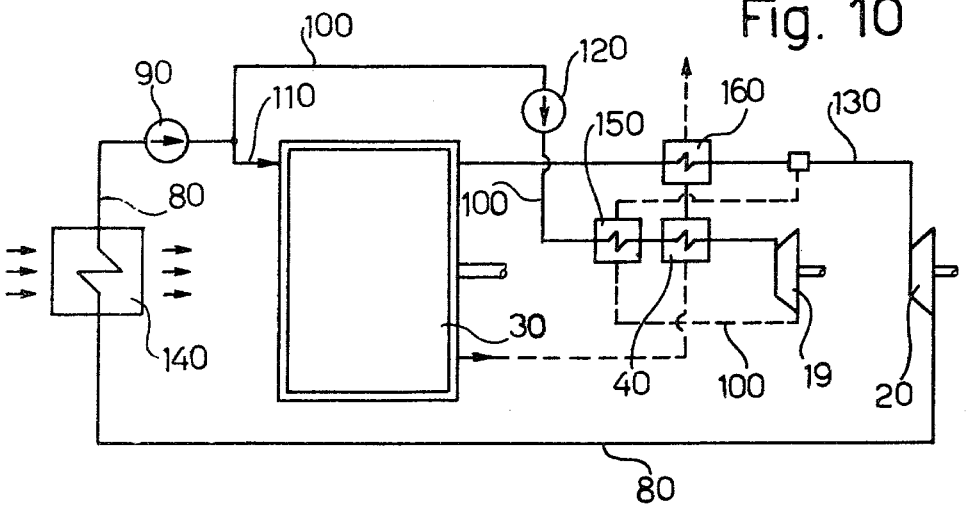

The variant shown in FIG. 10 is similar to the system of FIG. 9 but has in addition heat exchangers 150, 160 of a regenerative heating loop which is the same as the regenerative heating loop of FIG. 4.

Figure 11:
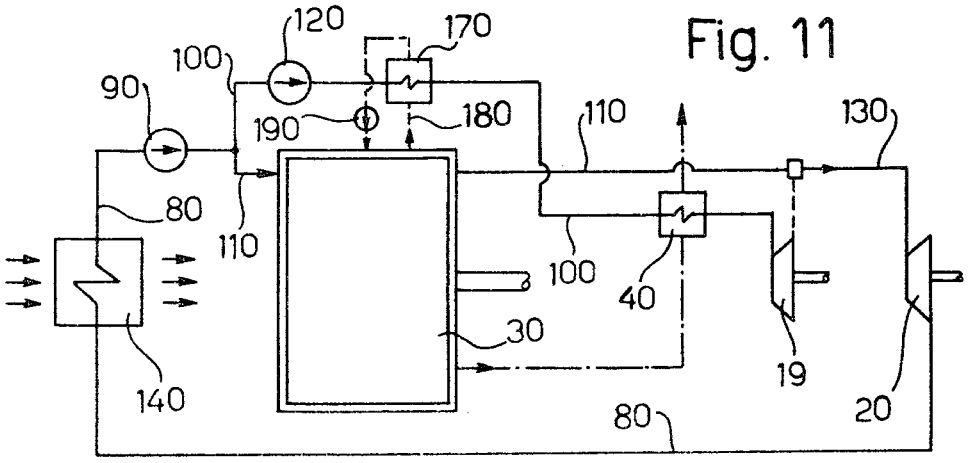

The system illustrated in FIG. 11 is similar to the system of FIG. 9 but differs in that it includes an auxiliary heat exchanger 170 in the first branch duct 100, which heat exchanger is traversed by a duct 180 through which the lubrication oil of the engine 30 is caused to flow by means of a circulation pump 120. Alternatively, instead of the hot lubrication oil, the hot compressed air of the supercharger system (if the engine has a supercharger) can be caused to flow in the duct 180 and through the heat exchanger 170 to effect a preliminary heating of the working fluid in the first branch duct 100, before it passes on to the exhaust gas heat exchanger 40.

Figure 12:
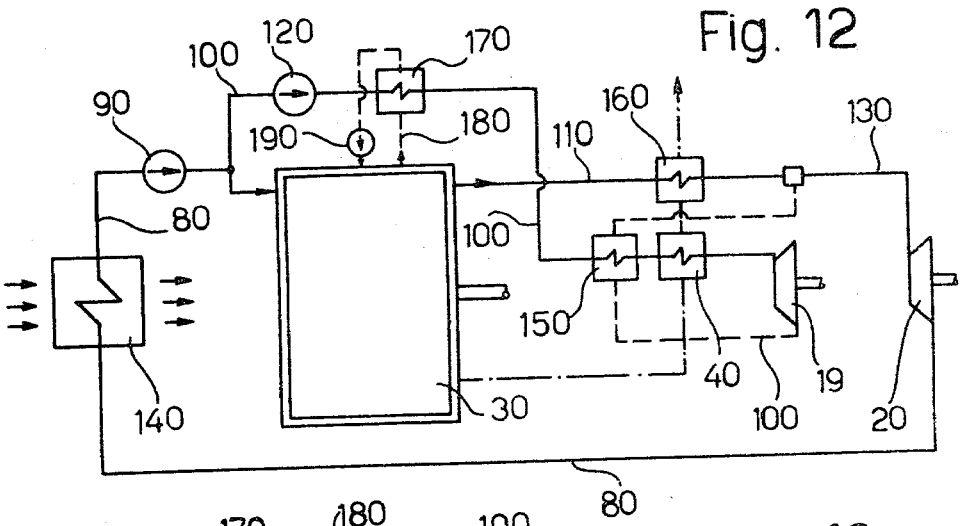

The system illustrated in FIG. 12 is the same as the system of FIG. 11, but differs in that there are provided further heat exchangers 150, 160 in the configuration of a regenerative heating loop as in FIG. 4.

Figure 13:
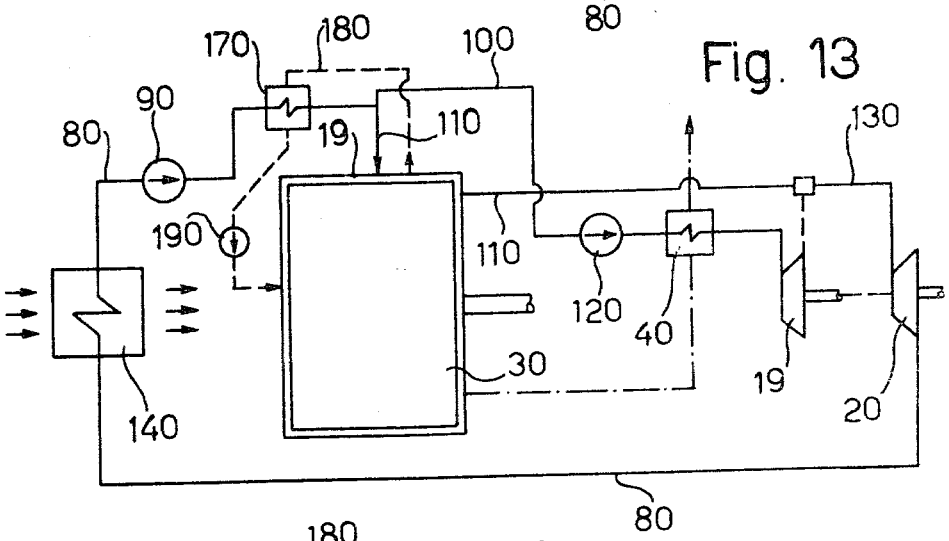

The system illustrated in FIG. 13 is a variant of the system illustrated in FIG. 11, differing from it by the fact that instead of being located in the first branch duct 100 the auxiliary heat exchanger 170 is located instead in the main duct 80 for the working fluid upstream of the point where it branches into the two branch ducts 100, 110. In this case all of the working fluid flowing in the main duct 80 passes through the auxiliary heat exchanger 170 instead of only a part of it as in the embodiment of FIG. 11.

Figure 14:
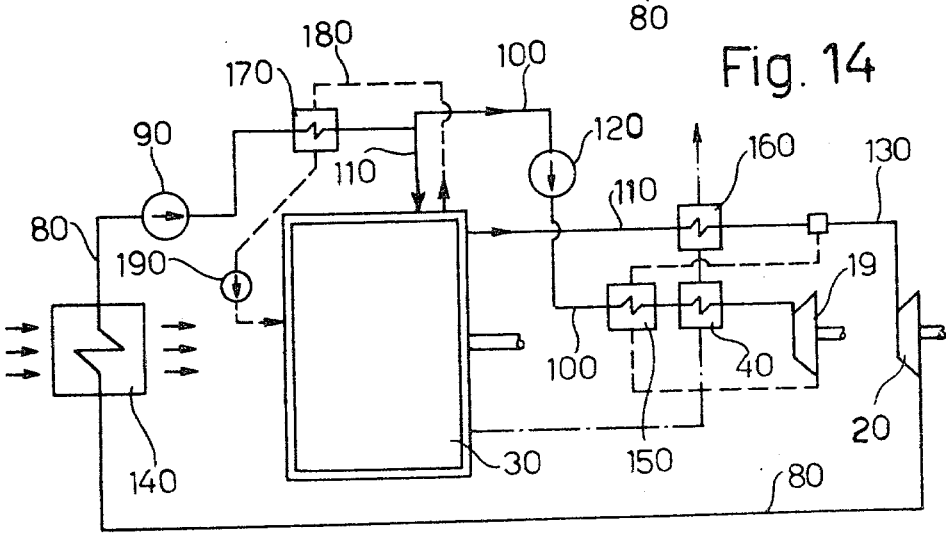
Figure 15:
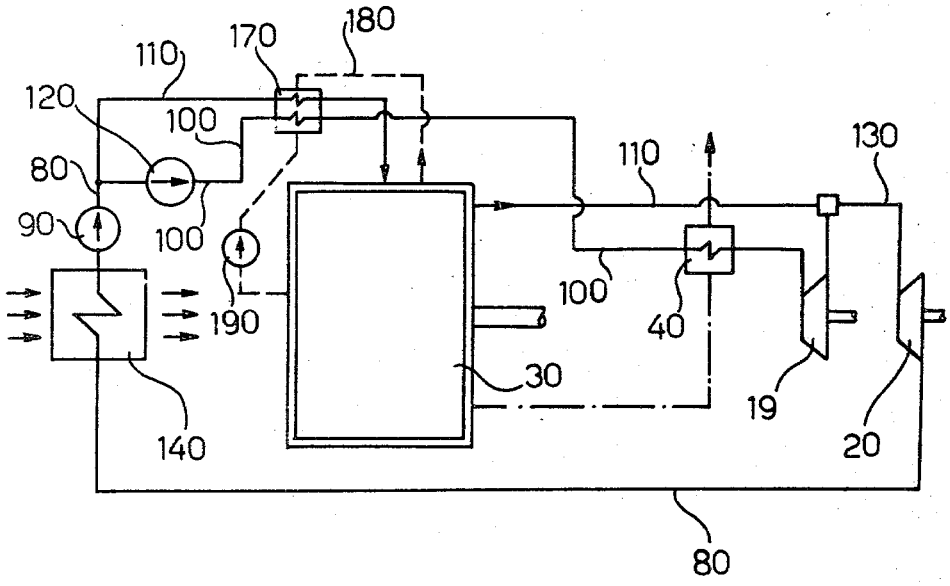

The system illustrated in FIG. 14 is similar to that of FIG. 13 but further includes heat exchangers 150, 160 in the configuration of a regenerative heat loop as described in relation to FIG. 4.

Figure 16:
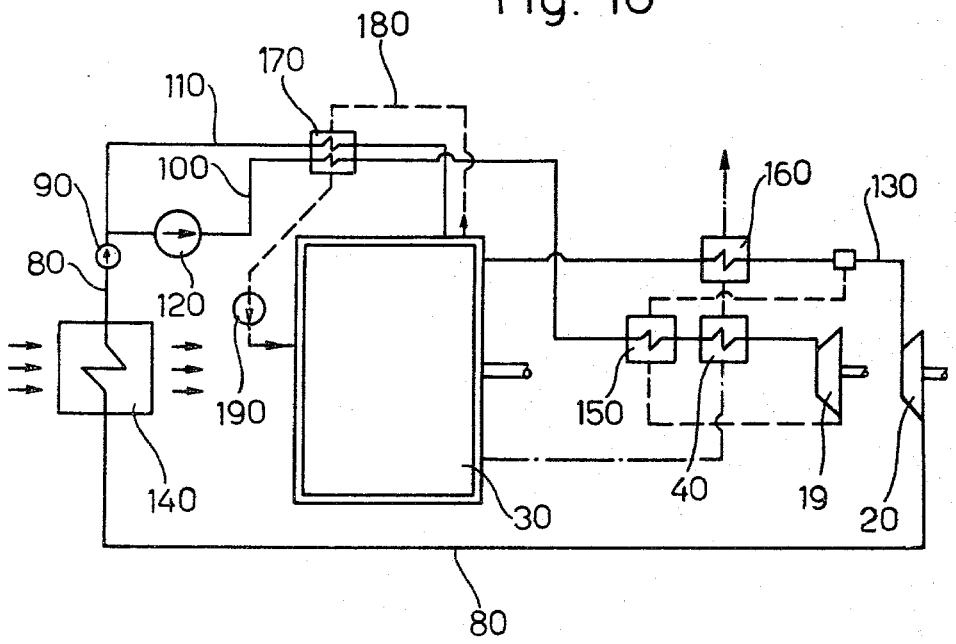

The system of FIG. 15 is again similar to that of FIG. 11, differing only by the fact that the second branch duct 110 also traverses the auxiliary heat exchanger 170 before directing the fluid therein into the auxiliary cooling jacket of the heat engine 30. The system of FIG. 16 is the same as that of FIG. 15, but with the addition of heat exchangers 150, 160 in the configuration of a regenerative heating loop as described in relation to FIG. 4.

It has been found that fitting a system according to the present invention, for example of the type illustrated in FIG. 3 or FIG. 4, to a liquid-cooled diesel engine of a size between 200 and 500 horsepower produces mechanical power of the order of 14–18% of the power of the engine.

Figure 17:
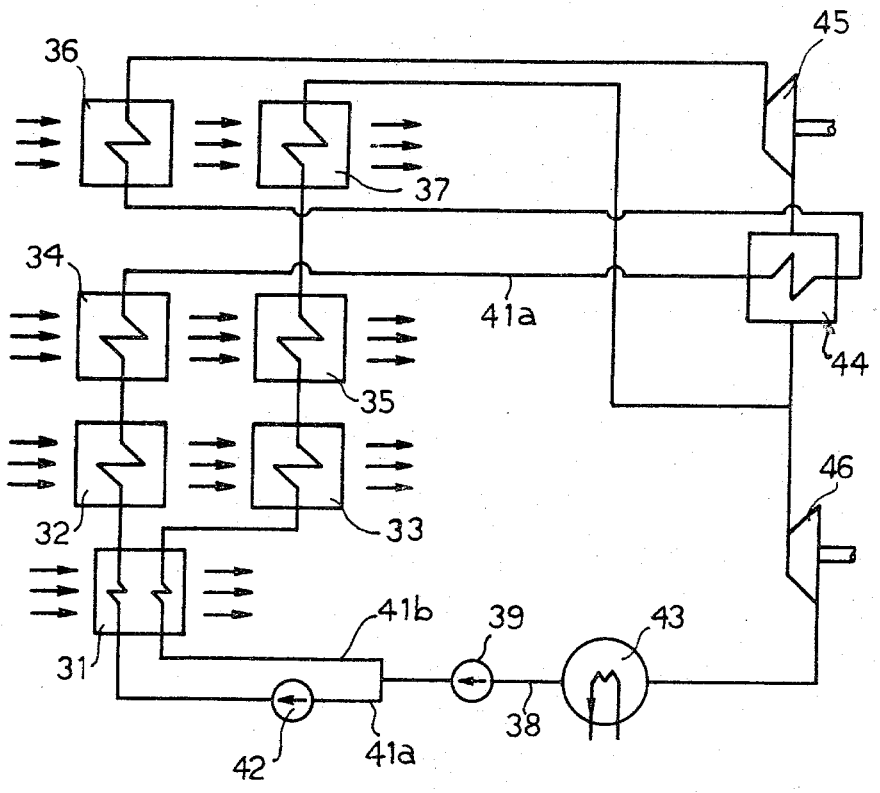
FIG. 17 is a schematic diagram of a system constituting a further embodiment of the present invention, for use with a heavy commercial diesel engine.

FIG. 17 illustrates another embodiment of the invention, this embodiment being adapted for use with a heavy commercial diesel engine. The embodiment illustrated is adapted for use with an engine having available four heat sources constituted, in increasing order of temperature from the coolest to the hottest, by the coolant liquid for the pistons of the engine (at a temperature in the region of 50° C.), the coolant liquid for the cylinders of the engine (at a temperature in the region of 60° C.), the air from the supercharger system of the engine (at a temperature in the region of 90°–120° C.), and the exhaust gases of the engine (at a temperature in the region of 300° C). In order to transfer heat from these four heat sources the system comprises a first heat exchanger 31 through which passes the piston coolant liquid (conventionally water), two further heat exchangers 32, 33 through which passes the cylinder coolant liquid (again conventionally water), two heat exchangers 34, 35 through which passes the air from the supercharger, and finally two exhaust gas heat exchangers 36, 37 through which pass the exhaust gases emitted by the engine. The system also includes a first, high pressure expander 45 and a second, low pressure expander 46. The working fluid of the system is contained in a main duct 38, through which it is circulated by a circulation pump 39. The main duct 38 branches into a first branch duct **41*a* and a second branch duct 41*b*. The first branch duct 41*a*, in which is inserted a second pump 42, traverses successively the heat exchangers 31, 32, 34 and 36 and then the two expanders 45 and 46. In the duct 38, between the downstream expander 46 and the pump 39 there is located a condenser 43 for condensing the fluid coming from the downstream expander 46. In the first branch duct 41*a*, between the heat exchanger 34 and the heat exchanger 36 there is a further heat exchanger 44 through which flows, as heating fluid, the working fluid on its way from the first or upstream expander 45 to the second or downstream expander 46. In this way it is possible to obtain preheating of the working fluid before it flows into the heat exchanger 36, by utilising some of the residual heat in the working fluid coming from the expander 45**.

The second branch duct **41*b* passes successively through the heat exchangers 31, 33, 35 and 37 and then rejoins the first branch duct 41*a*, downstream of the further heat exchanger 44 and upstream of the expander 46**.

Naturally the details of construction of the system of FIG. 17 can be widely varied. For example instead of branching upstream of the heat exchanger 31, the duct 38 could branch at another point of the circuit, such as downstream of the heat exchanger 31. Also the mixing of the fluid which flows through the first branch duct and the fluid which flows through the second branch duct can be effected at a different point from that illustrated in FIG. 17. Obviously not all the heat exchangers illustrated in FIG. 17 are indispensible. The elimination, for example, of the further heat exchanger 44 although it would be accompanied by a smaller recovery of heat, would at the same time permit a simplification of the system. Also the pumps 39 and 42 could be located at different positions. It would also be possibe, moreover, to devise a system similar to that illustrated in FIG. 17, but using a greater number of heat sources.

Naturally the principle of the invention remaining the same, the details of construction and the particular embodiments can be widely varied with respect to what has been described and illustrated purely by way of non-limitative example, without thereby departing from the spirit and scope of the present invention.

What is claimed is:

1. A heat recovery system for the production of mechanical energy from two heat sources respectively constituted by the cooling circuit of an internal combustion engine and the exhaust gases emitted by said internal combustion engine, said heat recovery system comprising a circuit for a working fluid, said circuit including:

first heat exchange means for transferring heat from said cooling circuit to said working fluid, second heat exchange means for transferring heat from said exhaust gases to said working fluid, first expander means and second expander means for expanding the heated working fluid and producing mechanical energy, a condenser disposed downstream of said first expander means and said second expander means, a circulation pump downstream of said condenser, a main duct for working fluid, in which said second expander means, said condenser and said circulation pump are interposed;

said main duct branching into a first branch duct and a second branch duct downstream of said circulation pump, said second heat exchange means being interposed in said first branch duct and said first expander means being also interposed in said first branch duct downstream of said second heat exchange means, an auxiliary pump in said first branch duct upstream of said second heat exchange means, said first branch duct rejoining said second branch duct upstream of said second expander means, and said first heat exchange means being disposed downstream of said circulation pump being traversed by the total flow of working fluid wherein said first heat exchange means is interposed both in said first branch duct and said second branch duct, said auxiliary pump being interposed in said first branch duct upstream of said first heat exchange means.

2. A heat recovery system as set forth in claim 1, further including:

third heat exchange means located in said first branch duct upstream of said second heat exchange means, said third heat exchange means being traversed by that part of said first branch duct which is downstream of said first expander means, and fourth heat exchange means located in said second branch duct and traversed by said exhaust gases downstream of said second heat exchange means.

* * * * *